United States Patent [19]

Murray

[11] 4,045,844

[45] Sept. 6, 1977

[54] SOCK LOCK DEVICE

[76] Inventor: David P. Murray, 53 George St., Watertown, Mass. 02172

[21] Appl. No.: 692,093

[22] Filed: June 2, 1976

[51] Int. Cl.[2] ..... A44B 21/00

[52] U.S. Cl. ..... 24/81 DM; 24/137 R

[58] Field of Search ..... 24/81 DM, 83, 137 R, 24/137 A, 138 R, 139 R, 139.1; 211/119.1

[56] References Cited

U.S. PATENT DOCUMENTS

| | | | |
|---|---|---|---|
| 2,166,884 | 7/1939 | White | 24/81 DM |
| 2,535,640 | 12/1950 | Levine | 24/137 R |
| 2,538,326 | 1/1951 | Popick | 24/137 A |
| 2,554,199 | 5/1951 | Lewis | 24/137 A |
| 3,013,654 | 12/1961 | Hott | 24/138 R |

*Primary Examiner*—Werner H. Schroeder
*Assistant Examiner*—Doris L. Troutman

[57] ABSTRACT

A sock lock device for maintaining a number of pairs of socks together during a washing and drying operation includes a number of clothespin elements detachably joined together, wherein each clothespin element is capable of maintaining one pair of socks together. A mechanism is provided for hanging the device on a clothesline for a drying operation.

4 Claims, 3 Drawing Figures

SOCK LOCK DEVICE

BACKGROUND OF THE INVENTION

A number of U.S. patents relate to devices for maintaining a pair of socks together during a washing operation. These patents are: U.S. Pat. Nos. 2,777,076 to Schenck, 3,414,944 to Rabinowitz; 3,688,348 to Klotz; 3,348,275 to Lawrence; 3,699,617 to Hofmeister; and 3,774,267 to Sneider. These aforementioned patents are non-applicable to my present invention.

SUMMARY OF THE INVENTION

My present invention relates to a unique and novel sock lock device adapted to hold a plurality of pairs of socks together during washing and drying operations.

An object of my present invention is to provide a sock lock device of simple design and construction, wherein the device is capable of maintaining pairs of socks together during a washing or drying operation.

Briefly, my present invention comprises a number of clothespin elements detachably joined together, wherein each clothespin element is capable of maintaining one pair of socks together. A mechanism is provided for hanging the device on a clothesline for a drying operation.

BRIEF DESCRIPTION OF THE DRAWINGS

The objects and features of the invention may be understood with reference to the following detailed description of an illustrative embodiment of the invention, taken together with the accompanying drawings, in which.

DESCRIPTION OF THE PREFERRED EMBODIMENT

Figure 1:
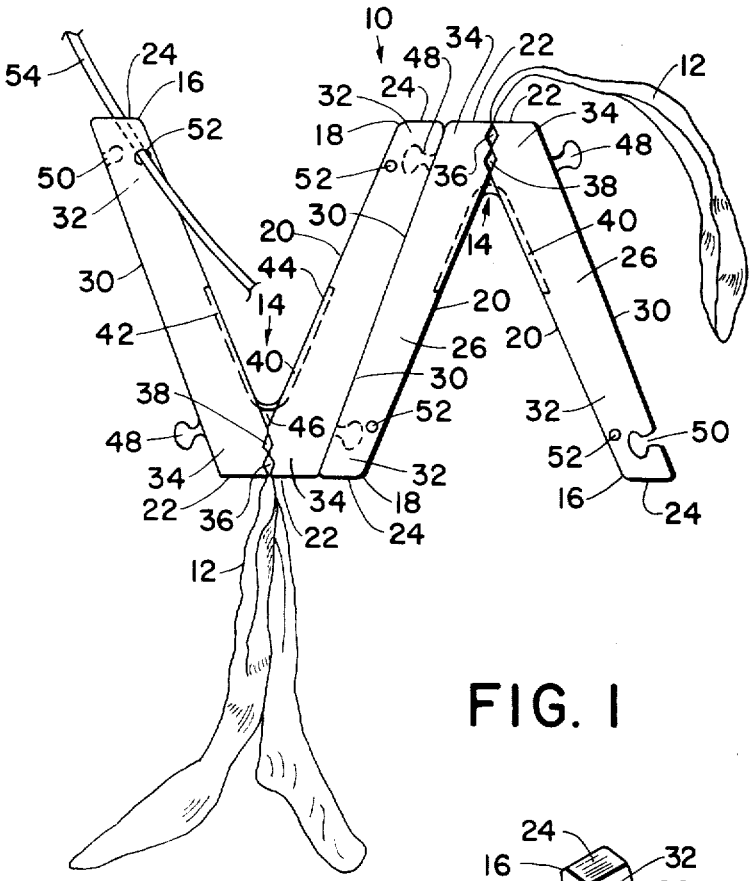
FIG. 1 illustrates a front cross-sectional view of a sock lock device.
Figure 3:
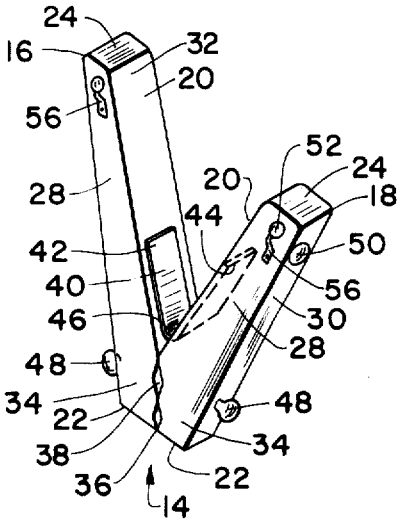
FIG. 3 illustrates a perspective cross-sectional view of one locking element of the sock lock device.

Turning now descriptively to the drawings, in which similar reference characters denote similar elements throughout the several views, FIGS. 1, 3 show a sock lock device 10 for holding a plurality of pairs of socks 12 together during a washing operation. The sock lock device 10 comprises a plurality of clothespin elements 14 detachably joined together, wherein one pair of socks 12 is adapted to be received into each element 14. Each element 14 includes a pair of elongated rectangularly-shaped bar members 16, 18. Each member 16, 18 has a base 20, a pair of upwardly extending ends 22, 24, a pair of upwardly extending sides 26, 28 and a top 30, wherein each bar member 16, 18 has a handle 32, and a jaw 34 end. The base 20 of each member 16, 18 is beveled upwardly to one end at the jaw end 34. The beveled portion 36 of each base 20 has a plurality of teeth 38 thereon. A U-shaped tension spring member 40 joins the two members 16, 18 together at the jaw ends 34 of the members 16, 18, wherein the beveled portions 36 of each member 16, 18 are abutted together. The legs 42, 44 of spring member 40 are embedded into the two members 16, 18, wherein the base 46 of spring member 40 is disposed towards the jaw ends 34 of the members 16, 18. The top of 30 of each member 16, 18 at the jaw end 34 thereof has a snap element 48 mounted thereon. A snap receiving element 50 is embedded in the top of each member 16, 18 at the handle end 32 thereof. Each member 16, 18 at a handle end 32 thereof has a transverse bore 52 therethrough, wherein the bores 52 are adapted to receive a clothesline 54 therethrough for hanging up the socks 12 to dry.

Figure 2:
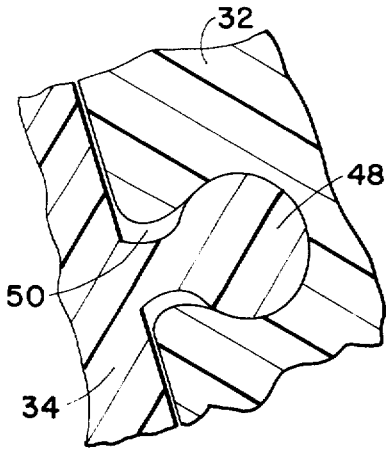
FIG. 2 illustrates a cross-sectional of a locking portion of a section of the sock lock device.

In use, one element 14 is inverted with respect to the next element 14 such that the snap element 48 of one element 12 can be received into the snap receiving element 50 of a second element 12 as depicted in FIGS. 1, 2.

FIG. 3 shows an alternate embodiment for hanging the element 14 from the clothesline 54. A clip member 56 is mounted onto each arm 16, 18 at a handle end 32 thereof.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A sock lock device adapted to maintain at least two pairs of socks together during a washing and a drying operation on a clothesline, which comprises:
   a. at least two clothespin elements, each said clothespin element adapted to receive one said pair of socks therein and including a pair of arms, each said arm having a jaw end and a handle end;
   b. means for detachably joining said clothespin elements; and
   c. means for hanging said lock device from said clothesline, said detachably joining means further comprising:
   d. a snap element mounted on each said arm at said jaw end; and
   e. a snap receiving element embedded in each said arm at said handle end for receiving one said snap element therein.

2. A device according to claim 1, wherein each of said clothespin elements further comprises:
   a tension spring member, said tension spring member joining said two arms together in a V-shape configuration, said jaw ends of said two arms abutting together.

3. A device according to claim 1, wherein said hanging means further comprises each said handle end of each said arm of each clothespin element having a transverse bore therethrough, said bore of at least one said arm adapted to receive said clothesline therethrough.

4. A device according to claim 1, wherein said hanging means further comprises a clip member affixed to each said arm of each said clothespin element, at least one said clip member adapted to receive said clothesline therein.

* * * * *